US006607145B1

(12) United States Patent
Boriani et al.

(10) Patent No.: US 6,607,145 B1
(45) Date of Patent: Aug. 19, 2003

(54) SPRAY GUMMING UNIT

(75) Inventors: Silvano Boriani, Bologna (IT); Alver Tacchi, Bologna (IT); Alessandro Minarelli, Bazzano (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 09/702,756

(22) Filed: Nov. 1, 2000

(30) Foreign Application Priority Data

Nov. 10, 1999 (IT) ..... BO99A0614

(51) Int. Cl.[7] ..... B05B 15/02

(52) U.S. Cl. ..... 239/112; 239/104; 239/114; 239/115; 239/123; 239/541; 118/302; 118/410; 118/325; 118/76; 118/244; 118/253; 118/263

(58) Field of Search ..... 239/104, 106, 239/112, 114, 115, 123, 541; 15/246; 118/302, 410, 325, 76, 244, 253, 263; 134/104.1; 401/214

(56) References Cited

U.S. PATENT DOCUMENTS 3,672,328 A 6/1972 Kardon
4,387,002 A * 6/1983 Knecht ..... 118/302
4,704,308 A * 11/1987 Maneke et al. ..... 427/207.1
5,240,502 A * 8/1993 Castaldo et al. ..... 118/302
5,853,812 A * 12/1998 Kawasaki et al. ..... 118/302
6,116,518 A * 9/2000 Negrini et al. ..... 239/112

FOREIGN PATENT DOCUMENTS

DE 3908453 9/1990
EP 0911085 4/1999

* cited by examiner

*Primary Examiner*—Christopher Kim
(74) *Attorney, Agent, or Firm*—Davidson Berquist Klima & Jackson, LLP

(57) ABSTRACT

In a spray gumming unit, a gumming device is equipped with an ejector that sprays an adhesive substance and that is connected with a shutter element. The shutter element moves towards and away from the ejector between a position where it closes the ejector and in which a pad, fixed to one end of it, is in contact with the ejector, and a position where the ejector is left open. During the movement of the shutter element and of the pad between the ejector open and closed positions, an applicator applies an antiadhesive liquid substance on the pad.

17 Claims, 1 Drawing Sheet

SPRAY GUMMING UNIT

BACKGROUND OF THE INVENTION

The present invention relates to a spray gumming unit.

The invention can be used to good advantage in the field of packaging machinery, especially packing machines, to which the description below refers but without thereby restricting the scope of the invention.

In these machines, an adhesive substance must be applied to certain parts of paper sheets, such as blanks, for example, designed to be folded into containers or packets, or labels to be applied to the containers or packets.

Packing machines are known to be equipped with spray gumming units facing the line along which the paper sheets to be gummed are fed, each unit comprising at least one spray gummer whose gumming nozzle is connected to an adhesive feed system and is equipped with an adhesive ejector.

The disadvantage of spray gumming units of this type is that the gumming nozzle ejectors require frequent cleaning and maintenance, mainly because part of the adhesive dries on the ejectors during temporary stops in production.

To overcome this problem, the ejectors of the gumming units have been equipped with shutter elements that move towards and away from the ejectors between a position where the ejectors are closed and in which pads fixed to one end of the shutter elements are placed in contact with the ejectors, and a position where the ejectors are left open and an antiadhesive liquid substance is applied manually on the pads in order to prevent the pads and the adhesive from sticking in the closed position.

Obviously, a solution of this kind has the disadvantage of requiring the constant attendance of an operator to apply the antiadhesive substance on the pads.

SUMMARY OF THE INVENTION

The aim of the present invention is to provide a spray gumming unit that overcomes the disadvantage just described.

Accordingly, the invention provides a spray gumming unit, having at least one spray gummer with a gumming nozzle equipped with an adhesive ejector; the unit also having shutter means designed to keep the ejector closed during stops in gumming operations, said shutter means moving towards and away from the ejector, during such stops, between an ejector open position and an ejector closed position; and drive means for moving the shutter means between such open and closed positions; the unit being characterized in that it comprises applicator means for applying a liquid substance on a working portion of the shutter means as the shutter means themselves move between the open and closed positions.

BRIEF DESCRIPTION OF THE DRAWINGS

The invention will now be described with reference to the accompanying drawings, which illustrate a preferred embodiment of it and in which.

DESCRIPTION OF THE PREFERRED EMBODIMENTS

Figure 1:
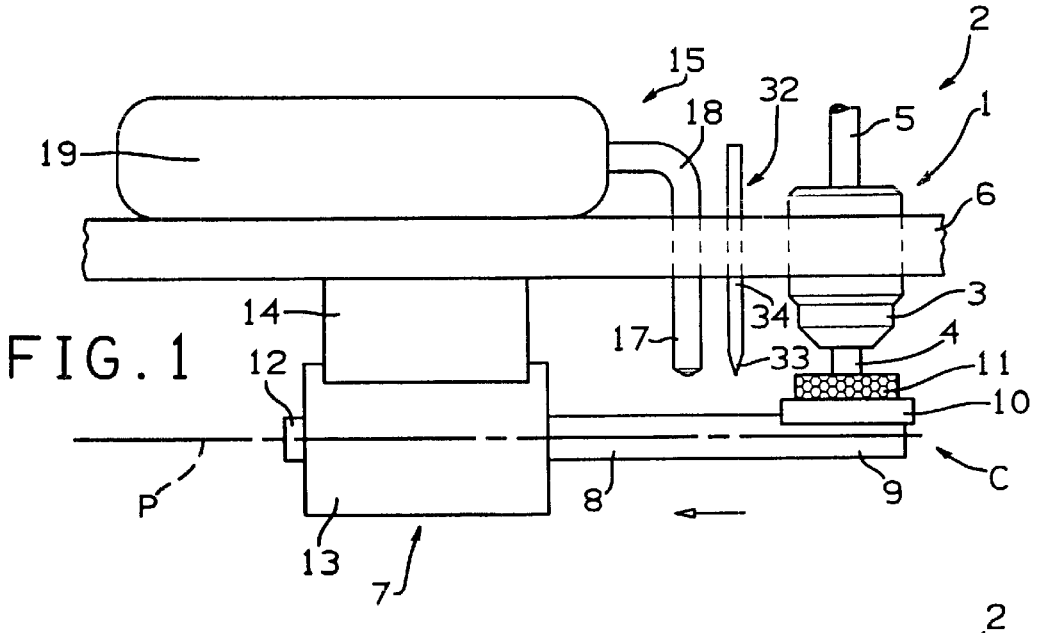
FIG. 1 is a schematic side elevation view, with some parts cut away to better illustrate others, showing a preferred embodiment of the spray gumming unit made according to the present invention at a first point in its operation.
Figure 2:
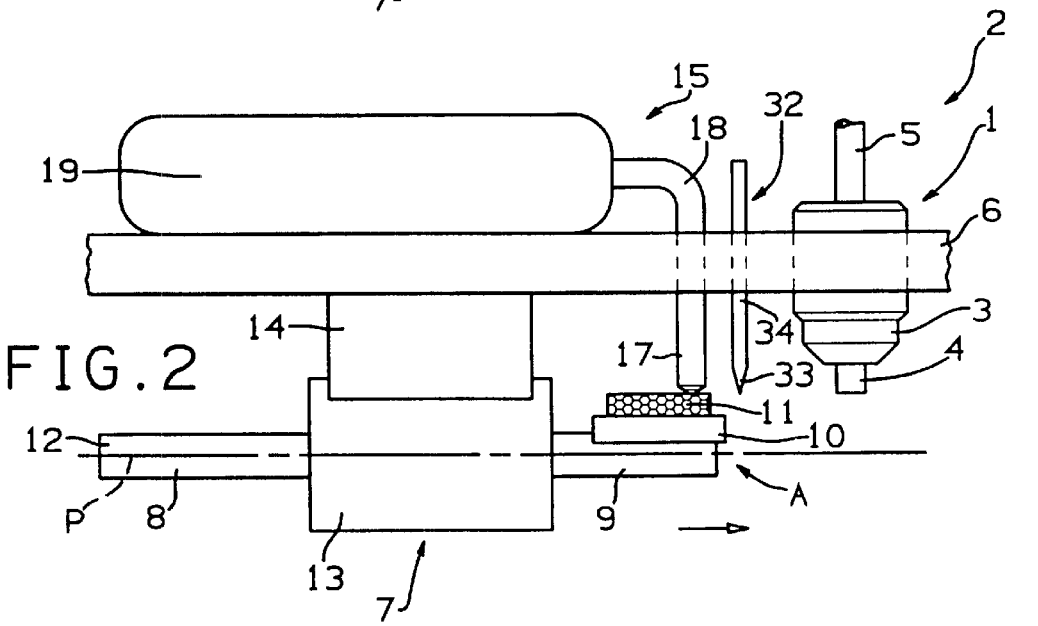
FIG. 2 is a side elevation view of the gumming unit illustrated in FIG. 1 showing the unit at a second point in its operation.

With reference to FIGS. 1 and 2, the numeral 1 indicates a spray gummer forming part of a spray gumming unit 2.

The gummer 1 has a gumming nozzle 3 equipped with an ejector 4 facing a line (not illustrated) along which sheets of paper to be gummed (not illustrated) are fed. On the side opposite the ejector 4, the gummer 1 also has an inlet pipe 5 connected in a known manner, which is not illustrated, to a glue feed system.

The gummer 1 is supported by a bracket 6, which, besides the gummer 1, also supports a shutter device 7 for the ejector 4.

The shutter device 7 comprises a shutter element consisting of a rod 8, to one end 9 of which there is rigidly connected a plate 10 that supports a pad 11 made preferably of a spongy elastic material or of felt. At its end 12 opposite the end 9, the rod 8 is driven in known manner (not illustrated) by a reversible motor 13 that moves it away from and towards the ejector 4 along a straight, horizontal path P. Looking in more detail, the motor 13 is mounted at the top on the bracket 6 by means of a plate 14, and is connected to a control unit (not illustrated) to move the rod 8 and the pad 11 between a position C where the ejector 4 is closed (FIG. 1) and in which the plate 10 faces the nozzle 3 and the pad 11 is in close contact with the ejector 4, and a position A where the ejector 4 is open (FIG. 2) and the plate 10 is positioned on one side of the nozzle 3.

The gumming unit 2 further comprises an applicator 15 designed to apply a thin film of an antiadhesive liquid substance 16, consisting of or containing silicone oil, on the pad 11 when it is at the open position A. Looking in more detail, the applicator 15 comprises a feeder 17 of the substance 16 located in a fixed position facing the plate 10 in position A.

The feeder 17 is connected, through an upper feed pipe 18 supported by the bracket 6, to an upper tank containing the substance 16, and has, on the side opposite the pipe 18, a cylindrical outlet 20 connected to a device 21 for metering/feeding the substance 16.

Figure 3:
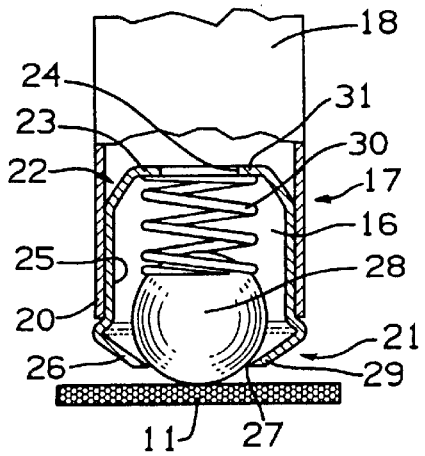
FIG. 3 is a scaled up detail view partly in cross section showing a part of the unit illustrated in FIGS. 1 and 2 at a third point in its operation.

As can be seen more clearly in FIG. 3, the device 21 comprises a bell-like casing 22 delimited, at the top, by a surface 23 with a circular hole 24 through the middle of it, which enables communication with the pipe 18, and, at the side, by a cylindrical surface 25 that fits snugly against the inner cylindrical surface of the outlet 20. The bottom of the surface 25 is shaped to form a truncated cone like surface 26 that protrudes from the outlet 20.

At the top of it, the surface 26 has an inside diameter that is substantially the same as the inside diameter of the outlet 20, and at the bottom of it, forms a circular central opening 27 that is smaller in diameter than the inside diameter of the outlet 20.

The device 21 further comprises a ball 28 that meters and applies the substance 16. The ball 28 is supported at the bottom by an edge 29 of the opening 27 in the surface 26, and is pressed against the edge 29 by a spring 30 placed between the ball 28 itself and an edge 31 of the hole 24 in the surface 23.

The gumming unit 2 also comprises an element 32 for cleaning the pad 11 and positioned along the path P between the feeder 17 and the nozzle 3. The cleaning element 32 comprises a skimming blade 33 which hangs from the bracket 6 by a rod 34 and is designed to remove glue residue from the pad 11 as the latter moves from position C to position A.

During a normal gumming cycle of the unit 2, the rod 8 of the shutter device 7 is positioned with the pad 11 located in the open position A and is covered with a film of antiadhesive substance 16, while the nozzle 3 feeds the glue in known manner through the ejector 4 (FIG. 2).

If the working cycle is temporarily stopped, the aforementioned control unit (not illustrated) disables the ejector 4 in a known manner to stop the flow of glue and activates the motor 13 to move the rod 8 and the pad 11 to position C (FIG. 1).

During its movement from position A to position C, the pad 11 brushes against the ball 28 and is covered by a further film of antiadhesive substance 16 that is gravity fed from the tank 19 to the feeder 17. After reaching position C, the pad 11, owing to its elastic properties, cleans, surrounds and seals the outlet of the ejector 4, thus preventing the glue residue on the outlet itself from solidifying. The film of antiadhesive substance 16 guarantees that the glue residue does not stick to the pad 11.

When the working cycle is resumed but before glue feed to the nozzle 3 starts up again, the motor 13 moves the rod 8 to its initial position, with the pad 11 in position A.

As it moves from position C to position A, the pad 11 is first skimmed by the skimming blade 33 which removes traces of glue from it, if any, and brushes against the ball 28 to become covered by another film of antiadhesive substance 16.

The above operating sequence is repeated every time the unit 2 stops.

It should be noted that application of the antiadhesive substance 16 to the pad 11 does not require any special automatic mechanism and is performed while the pad 11 itself moves to and from the open and closed positions. This, combined with the fact that the feeder 17 is gravity fed by the tank 19 through the pipe 18 makes the applicator 15 simple and economical.

Moreover, it should be stressed that, although the unit 2 illustrated in FIGS. 1 and 2 has a single gummer 1, the unit 2 may, without departing from the scope of the inventive concept, comprise a set of spray gummers 1 in various different arrangements, instead of the single spray gummer 1. Obviously, when there is a set of spray gummers 1, there may be either a single pad 11 for the entire set or a pad 11 for each spray gummer 1.

What is claimed is:

1. A spray gumming unit having at least one spray gummer with a gumming nozzle equipped with an adhesive ejector; the unit also having shutter means designed to keep the ejector closed during stops in gumming operations, said shutter means moving towards and away from the ejector, during such stops, between an open position and a closed position of the ejector; and drive means for moving the shutter means between such open and closed positions; the gumming unit comprising applicator means for applying an anti-adhesive liquid substance on a working portion of the shutter means as the shutter means moves between the open and closed positions; the applicator means comprising means for feeding the anti-adhesive liquid substance and metering means; said metering means being connected with the feeding means and comprising a ball for metering and applying the anti-adhesive liquid substance, the metering means constructed and arranged so that the ball automatically contacts the working portion of the shutter means as the shutter means moves between the open and closed positions to apply a thin film of the anti-adhesive substance to the working portion of the shutter means.

2. The unit according to claim 1, wherein the anti-adhesive liquid substance comprises silicone oil.

3. The unit according to claim 1, wherein the shutter means comprise a shutter element designed to move between the open and closed positions; a portion of the shutter element having connected to it means for supporting a pad that constitutes the working portion; the pad in the closed position being in contact with the ejector so as to close the injector, and being designed, as it moves to and from the open and closed positions, to receive the anti-adhesive liquid substance from the applicator means.

4. The unit according to claim 1, comprising means for cleaning the shutter means.

5. The unit according to claim 4, wherein the cleaning means comprise a blade for cleaning the pad.

6. The unit according to claim 2, wherein the shutter means comprise a shutter element designed to move between the open and closed positions; a portion of the shutter element having connected to it means for supporting a pad that constitutes the working portion; the pad in the closed position being in contact with the ejector so as to close the injector, and being designed, as it moves to and from the open and closed positions, to receive the anti-adhesive liquid substance from the applicator means.

7. The unit according to claim 1, wherein the applicator means is fixed with respect to the spray gumming unit such that the ball contacts the working portion of the shutter means through movement of the shutter means between the open and closed positions, the ball being movable with respect to the applicator means upon contact with the shutter means.

8. The unit according to claim 7, and further comprising a tank for containing the anti-adhesive liquid substance, wherein the anti-adhesive liquid substance is supplied from the tank to the metering means by gravity feed.

9. The unit according to claim 6, wherein the applicator means is fixed with respect to the spray gumming unit such that the ball contacts the working portion of the shutter means through movement of the shutter means between the open and closed positions, the ball being movable with respect to the applicator means upon contact with the shutter means.

10. The unit according to claim 9, and further comprising a tank for containing the anti-adhesive liquid substance, wherein the anti-adhesive liquid substance is supplied from the tank to the metering means by gravity feed.

11. The unit according to claim 3, wherein the applicator means is fixed with respect to the spray gumming unit such that the ball contacts the working portion of the shutter means through movement of the shutter means between the open and closed positions, the ball being movable with respect to the applicator means upon contact with the shutter means.

12. The unit according to claim 11, and further comprising a tank for containing the anti-adhesive liquid substance, wherein the anti-adhesive liquid substance is supplied from the tank to the metering means by gravity feed.

13. The unit according to claim 5, wherein the applicator means is fixed with respect to the spray gumming unit such that the ball contacts the working portion of the shutter means through movement of the shutter means between the open and closed positions, the ball being movable with respect to the applicator means upon contact with the shutter means.

14. The unit according to claim 13, and further comprising a tank for containing the anti-adhesive liquid substance, wherein the anti-adhesive liquid substance is supplied from the tank to the metering means by gravity feed.

15. The unit according to claim 1, and further comprising a tank for containing the anti-adhesive liquid substance, wherein the anti-adhesive liquid substance is supplied from the tank to the metering means by gravity feed.

16. The unit according to claim 3, and further comprising a tank for containing the anti-adhesive liquid substance, wherein the anti-adhesive liquid substance is supplied from the tank to the metering means by gravity feed.

17. The unit according to claim 5, and further comprising a tank for containing the anti-adhesive liquid substance, wherein the anti-adhesive liquid substance is supplied from the tank to the metering means-by gravity feed.

* * * * *